US005522454A

United States Patent [19]

Gros et al.

[11] Patent Number: 5,522,454

[45] Date of Patent: Jun. 4, 1996

[54] CONDENSER MADE OF CONCRETE FOR AN AXIAL EXHAUST STEAM TURBINE, WITH SIMPLIFIED MOUNTING OF HEAT EXCHANGE BUNDLES

[75] Inventors: Jean-Pierre Gros, Villemomble; Gérard Foucher, Tremblay en France, both of France

[73] Assignee: GEC Alsthom Electromecanique SA, Paris, France

[21] Appl. No.: 439,497

[22] Filed: May 11, 1995

Related U.S. Application Data

[63] Continuation of Ser. No. 138,102, Oct. 20, 1993, abandoned.

[30] Foreign Application Priority Data

Oct. 21, 1992 [FR] France ..... 92 12581

[51] Int. Cl.[6] ..... F28F 9/013

[52] U.S. Cl. ..... 165/82; 165/67; 165/83; 165/162; 165/DIG. 59

[58] Field of Search ..... 165/67, 82, 162, 165/83, DIG. 59

[56] References Cited

U.S. PATENT DOCUMENTS

| | | | |
|---|---|---|---|
| 1,536,148 | 5/1925 | Scanes et al. | 165/67 X |
| 1,769,963 | 7/1930 | Price | 165/162 X |
| 1,772,806 | 8/1930 | Grace | 165/162 |
| 1,831,454 | 11/1931 | Kirgan . | |
| 1,894,279 | 1/1933 | Meyer | 165/82 |
| 2,088,931 | 8/1937 | Sengstaken | 165/162 |
| 2,181,486 | 11/1939 | Jenkins | 165/162 |
| 2,237,903 | 4/1941 | Drake | 165/82 |
| 2,876,975 | 3/1959 | Short | 165/162 |
| 4,183,401 | 1/1980 | Bell, Jr. et al. | 165/159 |
| 4,450,902 | 5/1984 | Bosne | 165/82 |
| 4,619,315 | 10/1986 | Waryasz | 165/162 X |
| 4,738,310 | 4/1988 | Luttenberger et al. | 165/158 |
| 5,094,588 | 3/1992 | Gros | 415/213.1 |
| 5,106,264 | 4/1992 | Gros | 415/213.1 |
| 5,108,258 | 4/1992 | Gros | 415/213.1 |

FOREIGN PATENT DOCUMENTS

| | | | |
|---|---|---|---|
| 2651276 | 3/1991 | France . | |
| 492871 | 3/1927 | Germany | 165/162 |
| 121510 | 12/1918 | United Kingdom . | |
| 1015052 | 12/1965 | United Kingdom . | |

*Primary Examiner*—Leonard R. Leo

*Attorney, Agent, or Firm*—Sughrue, Mion, Zinn, Macpeak & Seas

[57] ABSTRACT

A condenser made of concrete for an axial exhaust turbine, the condenser being carried on a concrete raft and including a plurality of superposed bundles of heat exchange tubes, wherein the condenser includes end vertical tube plates connected via flexible seals to the walls of the condenser and intermediate vertical tube plates, said tube plates being secured to one another by ties and supporting the tubes of the bundles so that they are free to expand, the intermediate plates adjacent to the end plates being carried by internal steel support brackets that are fixed to the walls of the condenser. The bundles of heat exchanger tubes are easily mounted and maintenance thereof is facilitated.

6 Claims, 3 Drawing Sheets

CONDENSER MADE OF CONCRETE FOR AN AXIAL EXHAUST STEAM TURBINE, WITH SIMPLIFIED MOUNTING OF HEAT EXCHANGE BUNDLES

This is a continuation of application Ser. No. 08/138,102 filed Oct. 20, 1993, now abandoned.

The present invention relates to a condenser made of concrete for an axial exhaust steam turbine, the condenser being carried by a concrete raft and including a plurality of bundles of heat exchange tubes.

BACKGROUND OF THE INVENTION

Such a condenser is described in document FR-A-2 651 276.

In such a condenser, the bundles are mounted by means of vertical internal ties that suspend the bundles from the walls of the condenser. However, the presence of such ties is highly detrimental to the flow of steam.

OBJECT AND SUMMARY OF THE INVENTION

When bundles are mounted in accordance with the invention, they are made very largely independent of the condenser enclosure, thus facilitating maintenance, and in particular total replacement of the bundles.

The condenser of the invention includes end vertical tube plates connected via flexible seals to the walls of the condenser and intermediate vertical tube plates, said tube plates being secured to one another by ties and supporting the tubes of the bundles so that they are free to expand, the intermediate plates adjacent to the end plates being carried by internal steel support brackets that are fixed to the walls of the condenser.

One of the intermediate plates supported by an internal support is provided with at least one resilient pad at its base, making longitudinal displacement possible. The other such plate is fixed relative to its internal steel support.

In a preferred embodiment of the invention, the condenser includes concrete stands inside the condenser and carried by the raft, which stands support the intermediate plates of those bundles that are situated adjacent to the raft.

In addition, the plates supported by the concrete stands are provided with resilient pads at their bases, making longitudinal displacement possible.

The bundles are thus supported and guided. The bundles are free-standing and they are free to expand.

BRIEF DESCRIPTION OF THE DRAWINGS

The present invention will be better understood in the light of the following description, made with reference to the accompanying ,drawings, in which.

MORE DETAILED DESCRIPTION

Figure 1:
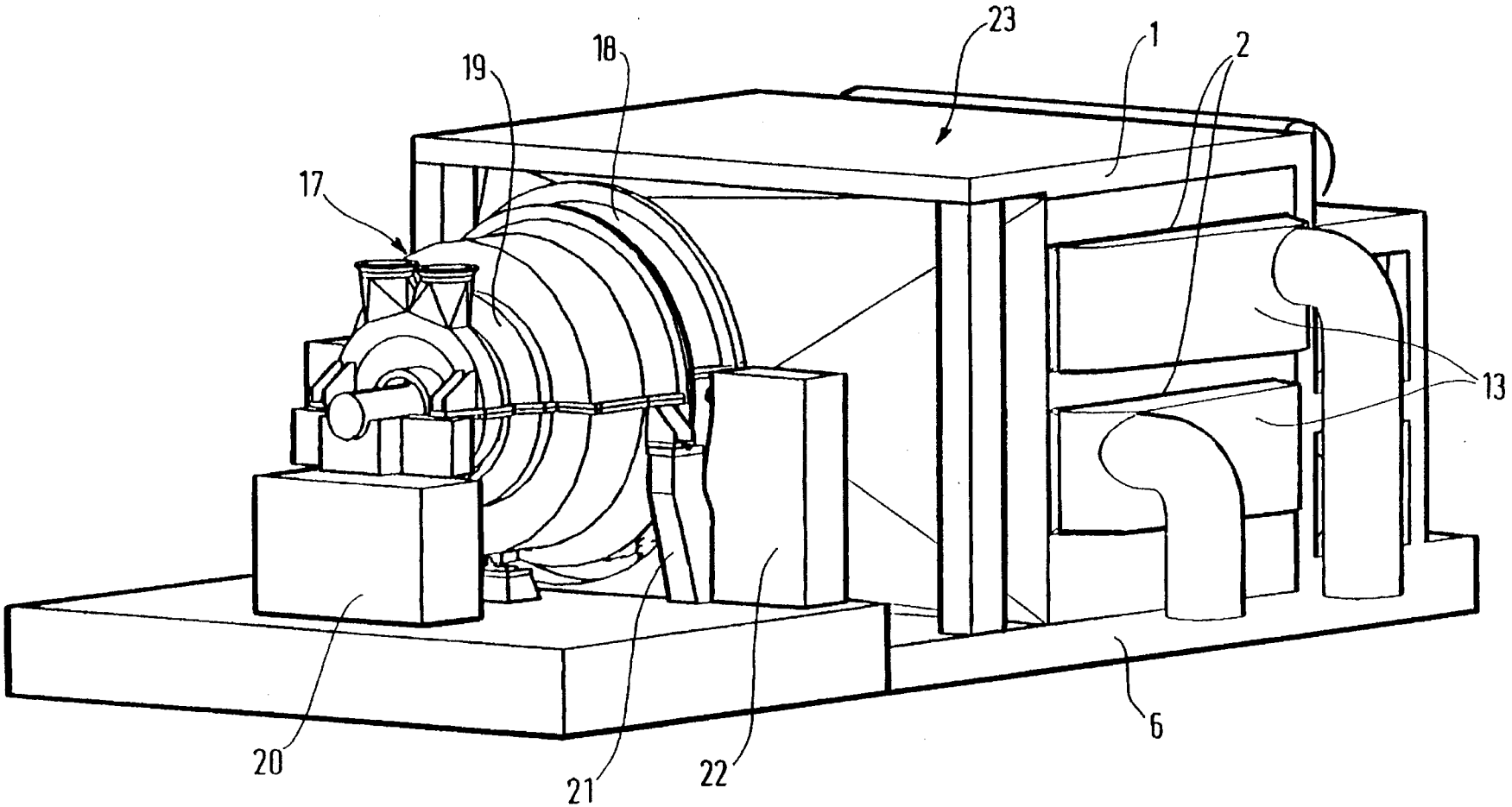
FIG. 1 shows an axial exhaust turbine having a condenser made of concrete situated in line therewith.

The steam turbine 17 has an axial exhaust 18 that forms a portion of its stator 19 (see FIG. 1).

It stands on a concrete raft 6 via concrete stands or blocks 20, 21, and 22. A condenser 23 made of concrete is situated in line with the exhaust 18. It includes an enclosure 1 whose bottom wall is constituted by the raft 6.

The front wall of the enclosure 1 corresponds to the sleeve that couples the turbine 17 to the condenser 23. It is in the form of a truncated pyramid.

The side walls are provided with openings 2 for passing the ends of a plurality of superposed bundles of tubes. These bundles are provided with respective water tanks 12 and 13 at each end. The bundles of tubes are situated on either side of the (extended) axis of the turbine.

Figure 2:
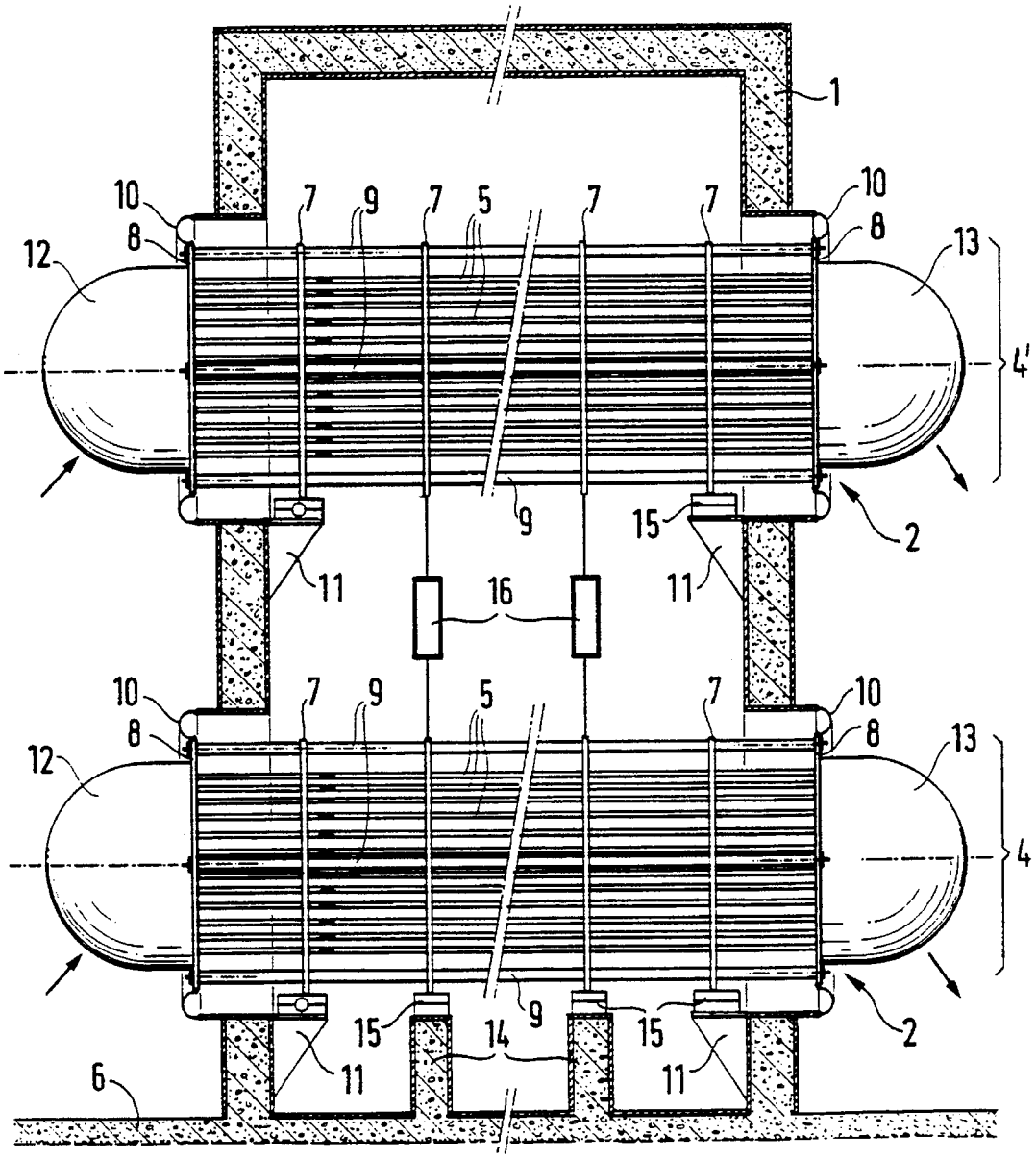
FIG. 2 is a section through a first embodiment of a condenser of the invention.

In the condenser of the invention (see FIG. 2) the tubes 5 of the superposed bundles 4 and 4' are mounted free to expand through vertical tube plates 7 and through end vertical tube plates 8. The bundles are situated downstream from the turbine so that the steam encounters the bundles 4, 4' after travelling a mean distance in a generally rectilinear stream.

The various tube plates 7 and 8 are secured to one another by horizontal ties 9.

The walls of the enclosure 1 are provided beneath the openings 2 with steel support brackets 11 that carry the vertical perforated plates 7 closest to the end plates 8.

The openings 2 are connected to the corresponding end plates 8 via respective flexible seals 10 of U-shaped section.

The water tanks 12 and 13 are fixed to the end plates 8.

In addition, the bottom bundle 4 is supported by concrete stands 14 inside the enclosure and supported by the raft 6. These stands 14 carry the vertical plates 7 that are not supported by the walls of the condenser.

Resilient pads 15 are disposed beneath the plates 7 that are supported by the concrete stands 14, and one of the plates 7 adjacent to the end plates likewise stands on a resilient pad 15. However, the other such plate 7 is fixedly mounted on its support bracket 11. The resilient pads 15 enable the bundles 4 and 4' to expand longitudinally.

For the bundles 4 and 4', ties 16 extend between the plates 7 of the upper bundle 4' and the plates 7 of the lower bundle 4 in order to adjust the resonant frequencies of the assembly.

Figure 3:
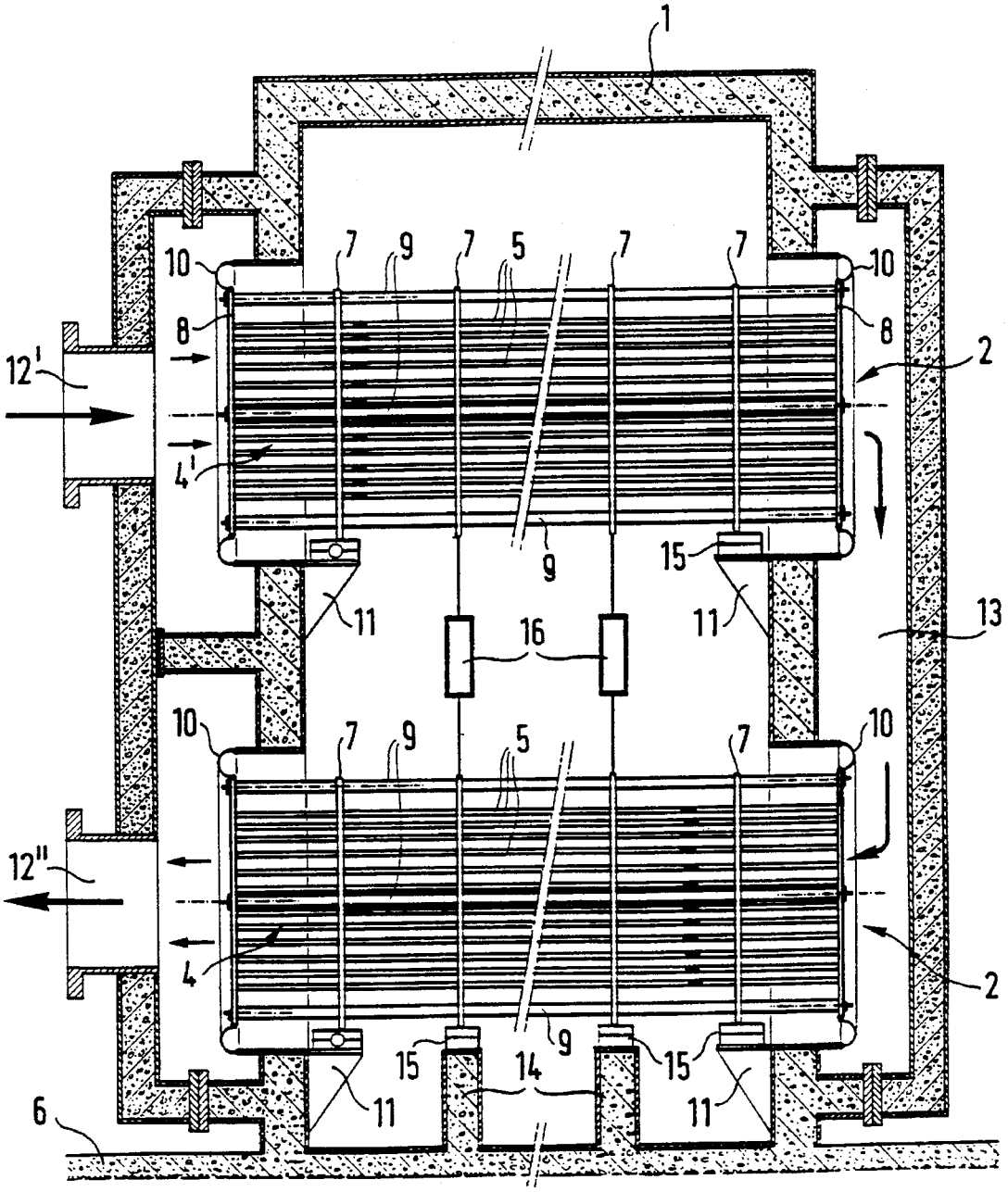
FIG. 3 is a section through a second embodiment of a condenser of the invention.

In the second embodiment shown in FIG. 3, the water tanks are made of concrete and they are secured to the walls of the enclosure.

Thus, water enters the top bundle via the top front tank 12', leaves the top bundle 4' to enter the bottom bundle 4 via the rear tank 13, and finally leaves the bottom bundle 4 via the bottom front tank 12".

We claim:

1. A condenser for an axial exhaust turbine, the condenser being carried on a concrete raft, the condenser comprising:

a single concrete enclosure having the concrete raft for a bottom wall, a top wall, and side walls;

a plurality of superposed bundles of heat exchange tubes located in the enclosure, each of said bundles having two end vertical tube plates and a plurality of intermediate vertical tube plates, said heat exchange tubes being mounted through said two end vertical tube plates and through said plurality of intermediate vertical tube plates, such that said heat exchange tubes are free to expand;

a plurality of ties extending between said two end vertical tube plates, said end vertical tube plates and said plurality of intermediate vertical tube plates being secured on said plurality of ties;

said side walls being provided with openings, each of said end vertical tube plates of each of said bundles passing through one of said openings;

internal steel support brackets secured on said side walls, said internal steel support brackets supporting said intermediate vertical tube plates adjacent to said two end vertical tube plates; and flexible seals mounted between each of said end vertical tube plates of each of said bundles and the side walls.

2. A condenser according to claim 1, further comprising resilient pads between said internal steel support bracket and said intermediate vertical tube plates supported by said internal steel brackets.

3. A condenser according to claim 1, further comprising concrete stands on the raft, said concrete stands supporting said intermediate vertical tube plates of the bundles adjacent to the raft.

4. A condenser according to claim 3, further comprising resilient pads between said concrete stands and said intermediate vertical tube plates supported by said concrete stands.

5. A condenser according to claim 1, further comprising water tanks which are made of concrete and which are secured to the side walls of the condenser around said openings.

6. A condenser according to claim 1, further comprising water tanks which are secured to the end vertical tubes plates.

* * * * *